United States Patent [19]

Grindley

[11] Patent Number: 4,832,704

[45] Date of Patent: May 23, 1989

[54] METHOD FOR ENHANCING THE DESULFURIZATION OF HOT COAL GAS IN A FLUID-BED COAL GASIFIER

[75] Inventor: Thomas Grindley, Morgantown, W. Va.

[73] Assignee: The United States of America as represented by the United States Department of Energy, Washington, D.C.

[21] Appl. No.: 177,310

[22] Filed: Apr. 5, 1988

[51] Int. Cl.[4] ..... C10J 3/54

[52] U.S. Cl. ..... 48/197 R; 48/203; 48/206; 48/210

[58] Field of Search ..... 48/210, 206, 197 R, 48/202, 203; 423/231; 252/373

[56] References Cited

U.S. PATENT DOCUMENTS

| | | | |
|---|---|---|---|
| 3,061,421 | 10/1962 | Landau et al. | 423/231 |
| 4,154,581 | 5/1979 | Nack et al. | 48/206 |
| 4,233,275 | 11/1980 | Kimura et al. | 423/231 |
| 4,246,243 | 1/1981 | Fox | 423/231 |
| 4,252,778 | 2/1987 | Yang et al. | 423/231 |
| 4,273,749 | 6/1981 | Kimura et al. | 423/231 |
| 4,309,198 | 1/1982 | Moss | 48/210 |
| 4,375,362 | 3/1983 | Moss | 48/210 |
| 4,483,692 | 11/1984 | Patel | 48/210 |
| 4,599,160 | 7/1986 | Gerhold | 48/210 |

FOREIGN PATENT DOCUMENTS

| | | | |
|---|---|---|---|
| 47810 | 10/1978 | Japan | 48/210 |

*Primary Examiner*—Peter Kratz

*Attorney, Agent, or Firm*—Earl L. Larcher; Stephen D. Hamel; William R. Moser

[57] ABSTRACT

A process and apparatus for providing additional desulfurization of the hot gas produced in a fluid-bed coal gasifier, within the gasifier. A fluid-bed of iron oxide is located inside the gasifier above the gasification bed in a fluid-bed coal gasifier in which in-bed desulfurization by lime/limestone takes place. The product gases leave the gasification bed typically at 1600° to 1800° F. and are partially quenched with water to 1000° to 1200° F. before entering the iron oxide bed. The iron oxide bed provides additional desulfurization beyond that provided by the lime/limestone.

3 Claims, 1 Drawing Sheet

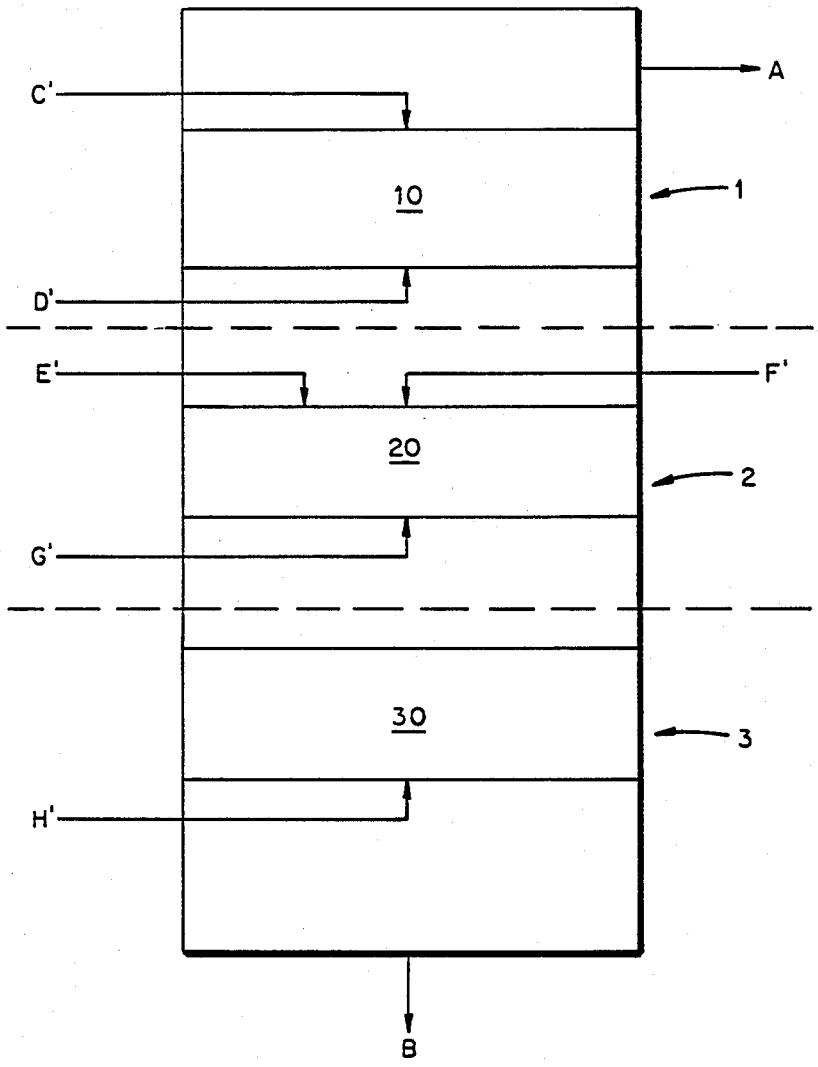
A
C'
10
1
D'
E'
F'
20
2
G'
30
3
H'
B

METHOD FOR ENHANCING THE DESULFURIZATION OF HOT COAL GAS IN A FLUID-BED COAL GASIFIER

FIELD OF THE INVENTION

The present invention relates to a method and apparatus for enhancing the desulfurization of hot coal gas in a fluid bed coal gasifier. More particularly, in-bed desulfurization is supplemented by means of a fluid bed of iron oxide located inside the gasifier above the gasification zone.

BACKGROUND OF THE INVENTION

In the process of coal gasification, coal is converted to volatile, gaseous products which are useful as sources of energy. These gaseous products usually include significant amounts of sulfur compounds such as hydrogen sulfide. These sulfur compounds are pollutants and must be removed from the product gas in some manner.

A current approach to hot gas desulfurization in fluid-bed coal gasifiers for gas turbine and fuel cell application is to combine in-bed desulfurization using lime/limestone with an external desulfurization process employing a fixed bed of zinc ferrite or an equivalent sulfur adsorbing compound. Generally, up to about 80% of the coal sulfur is removed by the lime/limestone and most of the remaining sulfur is removed by the external zinc ferrite fixed bed. In this process, the gas exiting the gasifier is partially quenched from about 1600° to 1800° F. to about 1000° to 1200° F. with water. This quenching ensures that the zinc ferrite sorbent remains stable and zinc vapor formation from the zinc ferrite bed is within acceptable limits.

The external desulfurization step employing a fixed bed of zinc ferrite is costly. Thus, there is a cost incentive to increase the amount of desulfurization accomplished within the gasifier. However, increased desulfurization within the gasifier cannot be accomplished by increasing the calcium to sulfur ratio within the gasifier bed because of chemical reaction equilibrium constraints. Thus, it is desirable to develop some other method for increasing desulfurization within the gasifier.

SUMMARY OF THE INVENTION

The present invention relates to an improved gasifier and an improved gasification process employing the improved gasifier. More particularly, the present invention relates to fluid-bed gasifiers of the type which include an oxidation bed, a gasification bed above the oxidation bed, a means for feeding fossil fuel and lime or limestone to the gasification bed and a means for feeding steam and air to the gasification bed. In this type of fluid-bed gasifier, gasification of the fossil fuel in the gasification bed forms gasification products which are removed from the top of the gasifier and calcium sulfide-containing ash which falls to the oxidation bed. The calcium sulfide ash is oxidized in the oxidation bed to calcium sulfate which is then removed along with the remaining ash from the bottom of the gasifier. The present invention provides a means for adding water to the gasification products above the gasification bed and an iron oxide bed above the means for adding water such that additional in-bed desulfurization can be accomplished in the gasifier by the iron oxide bed.

In the process of the present invention, the gasification products are quenched as they rise above the gasification bed by the addition of water. Then, as the gasification products continue to rise in the gasifier, they encounter the iron oxide bed which adsorbs sulfur containing materials from the gasification products.

Accordingly, it is the primary object of the present invention to provide an improved gasifier which increases the amount of desulfurization of gasification products within the gasifier.

It is a further object of the present invention to reduce the cost of desulfurizing gasification products from fluid-bed gasifiers.

It is a still further object of the present invention to provide a process which increases the amount of desulfurization of gasification products within a fluid-bed gasifier.

It is a still further object of the present invention to provide a process for desulfurizing gasification products of fluid-bed gasifiers at lower cost than present processes.

These and other objects of the present invention will be apparent to one of ordinary skill in the art from the detailed description which follows.

BRIEF DESCRIPTION OF THE DRAWING

The single FIGURE shows a schematic representation of a fluid-bed gasifier in accordance with the preferred embodiment of the present invention.

DETAILED DESCRIPTION OF THE PREFERRED EMBODIMENT

A schematic of the process in accordance with the present invention is illustrated in the single FIGURE. Coal is gasified in a fluid-bed gasifier divided into three zones 1–3 defined by the broken lines in the FIGURE. Each zone 1–3 consists of one or more fluid beds.

In typical operation coal F′ and lime/limestone E′ are fed to the middle zone 2 where gasification takes place in one or more fluid gasification beds 20 at temperatures of 1600°–1800° F. Steam/air G′ are also fed to the fluid gasification bed 20. The coal is gasified in the fluid gasification bed 20 and up to about 80% of the coal sulfur is absorbed by the lime/limestone according to the reaction $CaO+H_2S=CaS+H_2O$. Residual ash and calcium sulfide from the gasification bed drop into a lower zone 3 where calcium sulfide is oxidized in one or more fluid oxidation beds 30 to form calcium sulfate. Steam/air H′ are also fed to fluid oxidation bed 30. Also, in the oxidation bed 30 carbon in the ash is burned off. The remaining ash containing calcium sulfate is removed from the bottom of the gasifier as waste stream B.

Above the gasification bed, in upper zone 1, is one or more fluid iron oxide beds 10 which remove additional sulfur from the products of gasification over that amount of sulfur which was adsorbed by the lime/limestone. Water is added into the gases rising from the gasification bed 20 through water adding means D′ to lower the temperature of the hot gases to between 1000° and 1200° F. This lower temperature and the resulting gas composition ensure that the iron oxide bed 10 is in the form of magnetite, $Fe_3O_4$, and sulfur absorption takes place according to the reaction:

$$Fe_3O_4+3H_2S+H_2=3FeS+4H_2O$$

Product gases which have been further desulfurized by the iron oxide bed 10 rise above the iron oxide bed 10 and are removed from the gasifier as product stream A.

Iron oxide is added to the iron oxide bed 10 as stream C'. The iron sulfide formed by the sulfur adsorption drops into the gasification bed 20 where it gives up its sulfur content to the lime/limestone and is subsequently oxidized to hematite, $Fe_2O_3$ in the oxidation bed 30 in the lower zone 3.

The preferred form of iron oxide to be used in the iron oxide fluid-bed is granular iron oxide since it is readily available and inexpensive. Some possible sources of granular iron oxide are iron and steel industry wastes, power station fly ash wastes and aluminum industry wastes. In addition, iron oxide can be recovered from the gasifier ash for recycle to the iron oxide bed.

One of the primary advantages of the iron oxide fluid-bed is that the iron oxide catalyzes the carbon monoxide shift reaction. This has the advantage that, in further sulfur removal by, for example, an external zinc ferrite desulfurizer, a temperature rise resulting from the exothermic carbon monoxide shift reaction can be avoided. This provides additional assurance that zinc ferrite sorbent remains stable and that zinc vapor formation is within acceptable limits.

The use of an iron oxide fluid-bed provides several other significant benefits. For example, particulates in the gases from the gasification bed are removed in the iron oxide bed. This minimizes the amount of filtration of product gases that is necessary as the gasification product gases leave the gasifier. Further, the gasification product gases leave the gasifier at between 1000° and 1200° F. because of the quenching provided by the addition of water below the iron oxide bed. This temperature level permits easier filtration of the product gases and reduces the amount of scale formation on the filtration apparatus. Also, this temperature level is compatible with gas turbines, molten carbonate fuel cells and zinc ferrite desulfurizers. As a result, the product gas can be directly fed to any of these devices without a further cooling step.

The iron oxide bed of the present invention enhances the amount of sulfur compounds removed from the product gas of fluid-bed gasification over the amount which is removed by lime/limestone alone. Additionally, the lime/limestone requirement of the gasifier is reduced by the provision of an iron oxide fluid-bed located within the gasifier above the gasification bed.

The enhanced removal of sulfur compounds within the gasifier lessens the cost of additional sulfur removal external to the gasifier. This is important since iron oxide desulfurization agent is widely available at low cost whereas other sulfur removing compounds such as zinc ferrite are relatively expensive.

The foregoing description of embodiments of the invention has been presented for purposes of illustration and description. It is not intended to be exhaustive or to limit the invention to the precise forms disclosed, and many modifications and variations will be obvious to one of ordinary skill in the art in light of the above teachings. Accordingly, the scope of the invention is to be defined by the claims appended hereto.

What is claimed is:

1. In a gasification process of fossil fuel in a fluid-bed gasifier of the type wherein the gasifier includes an oxidation zone and a gasification zone above the oxidation zone, and wherein fossil fuel, lime and/or limestone, steam and air are fed to the gasification zone to effect gasification of the fossil fuel at a temperature of about 1600° to about 1800° F. to produce gasification products which are removed from the top of the gasifier and sulfide-containing ash which is oxidized to sulfate in the oxidation zone and which are removed along with the remaining ash from the bottom of the gasifier, the improvement which comprises the steps of:

adding water into the gasification products above the gasification zone to lower the temperature of the gasification products to about 1000° to 1200° F., and adsorbing sulfur-containing materials from the cooled gasification products into an iron oxide zone in the gasifier above the location at which water is added to the gasification products.

2. A process according to claim 1 wherein the iron oxide in the iron oxide zone comprises magnetite.

3. A process according to claim 1 and further including the step of feeding iron oxide to the top of the iron oxide zone during operation of the gasifier.

* * * * *